United States Patent [19]

LaCroix

[11] Patent Number: 4,842,277

[45] Date of Patent: Jun. 27, 1989

[54] MULTI-PURPOSE BATON

[76] Inventor: Eugene F. LaCroix, 5611-240th SE, Woodinville, Wash. 98072

[21] Appl. No.: 52,589

[22] Filed: May 20, 1987

[51] Int. Cl.[4] ..... A63B 59/00

[52] U.S. Cl. ..... 273/84 ES; 361/232; 362/102

[58] Field of Search ..... 273/84 R, 84 ES; 361/232; 362/102, 259

[56] References Cited

U.S. PATENT DOCUMENTS

| | | | |
|---|---|---|---|
| 786,040 | 3/1905 | Liberman et al. | 273/84 |
| 1,130,355 | 3/1915 | Von Eschen et al. | 273/84 R |
| 2,208,852 | 7/1940 | Mongan | 273/84 ES |
| 2,966,621 | 12/1960 | Voll | 273/84 R |
| 3,625,222 | 12/1971 | Shimizu | 273/84 ES X |
| 3,819,108 | 6/1974 | Jordan | 273/84 ES |
| 3,885,733 | 5/1975 | Klebold et al. | 361/232 X |
| 4,370,026 | 1/1983 | Dubroeucq et al. | 362/259 X |
| 4,479,171 | 10/1984 | Mains | 362/102 |
| 4,486,807 | 12/1984 | Yanez | 273/84 ES |
| 4,621,984 | 11/1986 | Fussell | 417/411 X |

FOREIGN PATENT DOCUMENTS

| | | | |
|---|---|---|---|
| 8605868 | 10/1986 | PCT Int'l Appl. | 273/84 ES |

*Primary Examiner*—Carlton R. Croyle
*Assistant Examiner*—Leonard P. Walnoha
*Attorney, Agent, or Firm*—Roy E. Mattern, Jr.

[57] ABSTRACT

An improved hand carried stick is provided for law enforcement personnel serving them as a billy, night stick, or baton, in the conventional way, with the additional self contained operational provisions when selectively activated via finger tipped switches, of: daylight or nighttime random threatening sparking along the projecting length portion thereof, a concentrated continuous ring like threatening sparking around the projecting end thereof, and/or the emitting of a temporary blinding laser beam of light from the projecting end thereof. The blinding of a person lasts only during the operation of this laser light of the improved hand carried stick, when a person or persons must be threatened to be subdued or be subdued by a person charged with law enforcement. The self contained electrical energy of this baton is supplied by one of two 9 volt direct current batteries. This electrical energy is converted, via self contained electrical components, to 50,000 volts of electrical energy available for discharge at two microamperes of current. The discharges, vai sparking, occur along and across spaced pairs of positive and negative charged conductive strips longitudinally positioned along the projecting length portion of the baton or stick to create the threatening observable random sparking during all operational discharge times. Also, if these unlike charged pairs of conductive strips are touched, then the person so touching is quickly subdued by receiving the 50,000 volts at this low current.

2 Claims, 4 Drawing Sheets

MULTI-PURPOSE BATON

DESCRIPTION

1. Technical Field

The present invention is directed toward the broad category of police-type activities such as non-invasive crown or individual activity control and in particular to a device which, solely because of its appearance, invokes restraint but also includes the capability of being used to apply a stunning voltage, project a blinding light or alternatively, apply a stunning physical impact. The device in addition to the above noted possibility of action modification, serves as a power source for remote auxiliary systems such as a laser site for firearms search and rescue light and the like.

2. Background Art

The use of batons, billys and other electronic or other physical devices for subduing individuals or for crowd control are well known.

These prior art devices are generally non-lethal and have included weighted instruments for subduing by impact, electronic discharge means subduing both humans and animals by means of electric shock or in some cases, a combination of the above.

Additional prior art devices have included flashlights which are weighted such that if the person intended to be subdued is not sufficiently responsive to the bright light, the body of the flashlight may be used for impact.

A search of the prior art devices disclosed U.S. Pat. No. 786,040 granted to Liberman et al on Mar. 28, 1905, which discloses a weighted billy club device including a flashlight and whistle.

U.S. Pat. No. 1,130,355 granted to Eschen et al on Mar. 2, 1915, likewise discloses a weighted physical subduing device including a flashlight.

U.S. Pat. No. 3,885,733 granted to Klebold et al on May 27, 1975, discloses an electric probe having an apparently unique method of mounting the power source and the electronic gear and also includes in addition to the electric probe, a buzzer and a flashlight.

Even though special efforts have been made to assure that the above noted devices are rugged and reliable, the type of use and stress to which they are subjected causes them to breakdown at an unpredictable time leaving the person relying on the device forced to resort to the physical, striking activity as the only source of control.

Further, the prior art devices as noted above and as known by the inventor have the disadvantage of being awkward, in that they are heavy and bulky, are not designed for ready and easy use and further, because of their very nature, particularly when used as a light source, serve to pinpoint a target for an adversary with a firearm.

DISCLOSURE OF THE INVENTION

The present invention addresses each of the above noted problems and deficiencies in the prior art devices and further, greatly enhances the capability of the user while simultaneously providing additional subduing characteristics.

With the above noted prior art and disadvantages in mind, it is an object of the present invention to provide a compact electronic wand wherein the material used, the particular arrangement of the required elements and the integration thereof provides a handy, easy to use and effective method of controlling one or more persons or animals.

It is another object of the present invention to provide a device for protection and control wherein the operator may selectively display an electric discharge effectively subduing a person visualizing the electric potential.

It is a further object of the present invention to provide a control device wherein the user has ready access to a built-in high intensity light source which may selectively be used. In addition, the light may be used as an auxiliary light source some distance from the user by means of an extension cord interconnected with the provided outlet jack on the inventive device.

It is yet another object of the present invention to provide a crown control device which may in face be provided in several different exterior configurations and sizes without substantially varying the adaptability and versatility thereof.

Still a further object of the present invention is to provide a crown control device wherein the main body portion of the device includes a plurality of selectively charged electrical conduits, these conduits are exposed such that they display an electrical potential by sparking when in use and further, instantly discharge a high voltage when contacted.

Still a further object of the present invention is to provide a baton-type device which is totally self-contained but also has the provision of having a portion of it i.e. a high intensity of light or laser source removed and used as an auxiliary device.

BEST MODE FOR CARRYING OUT THE INVENTION

Figure 1:
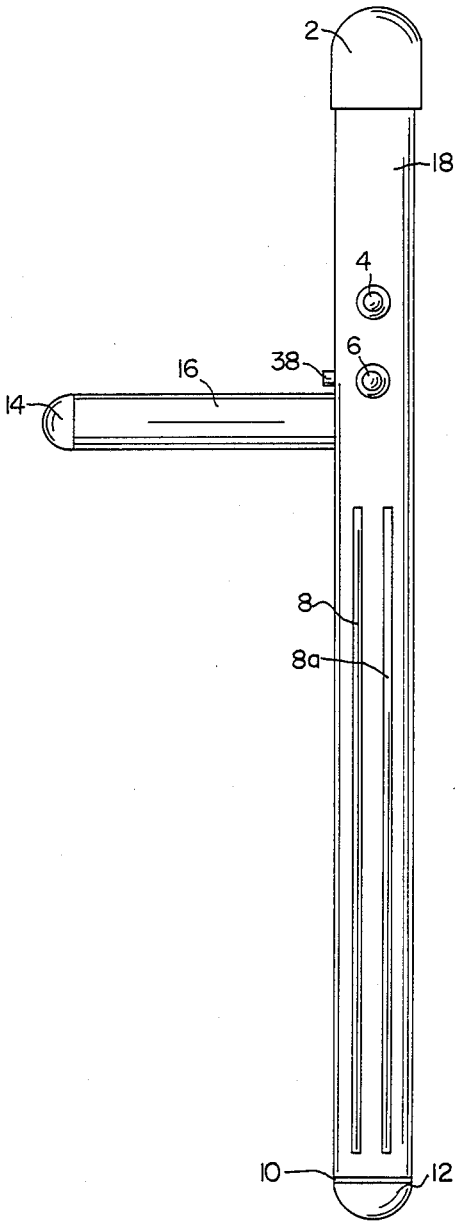
FIG. 1 is a side elevation of inventive electric control device showing the electronic elements and a utility sidearm.

As seen in FIG. 1, the present invention includes, in one embodiment, an elongated tubular main body portion 18 fabricated of a high impact non-conductive material, having a removable cap 2 secured to the back or handle end and an optical lens 12 at the forward end. Forwardly spaced from the removable cap 2 is a utility sidearm 16 having a removable cap 14 which is secured to the main body portion by ultrasonic welding or the like. As explained hereinafter, the components necessary for the present multi-purpose device are located within the body portion or the sidearm.

Extending over a substantial portion of the forward end of the baton are a plurality of parallel electrical conductive strips or wires 8, **8*a*** which, as will be described hereinafter, can be selectively charged such that a contact with this forward end of the baton will discharge the capacitance. Appropriate wiring could yield a discharge of up to 50,000 volts.

Immediately forward of the forward terminus of parallel strips 8, 8*a* is a metallic ring 10 circumscribing the device. The ring is spaced closely enough to the ends of wires 8, 8*a* such that when the capacitance load of the wires 8, 8*a* is reached, a continuous sparking will occur between the wires 8, 8*a* and grounding ring 10 serving as a visual deterrent.

Located on the handle or aft position of the main body portion 18 are switches 4, which is a push button, normally off, controlling power to the circuitry and 6, a three position switch which is normally off, serving as a fail-safe such that the stun gun or wand is inoperative when this switch is in the normal, or off position. The light, as explained hereinafter, will be rendered operable by activating switch 4 for 3–5 seconds to generate sufficient voltage. Position 2 of switch 6 is the ready position, the stun gun is ready to be fired or instantly charged by activating switch 4. Position 2 would be the normal position in a threatening or uncomfortable environment.

When switch 6 is in the third position, the light source can be utilized for vision, used to temporarily blind or strobed for disorientation of the person or persons to be controlled.

Figure 2:
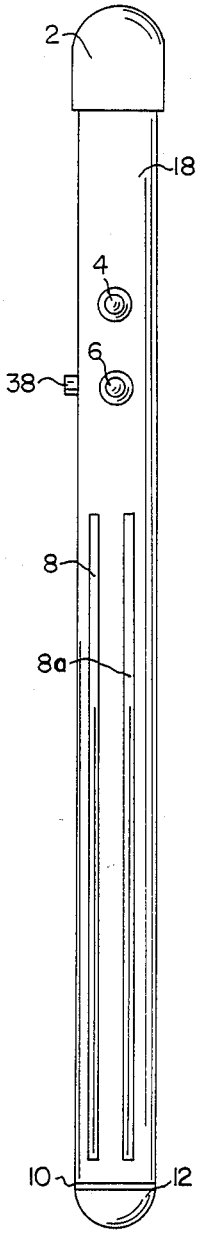
FIG. 2 is a view of a second embodiment of the present invention without the utility sidearm.

Referring now to FIG. 2, identical part numbers have been utilized to depict an alternate version of the inventive device without the sidearm 16.

Figure 3:
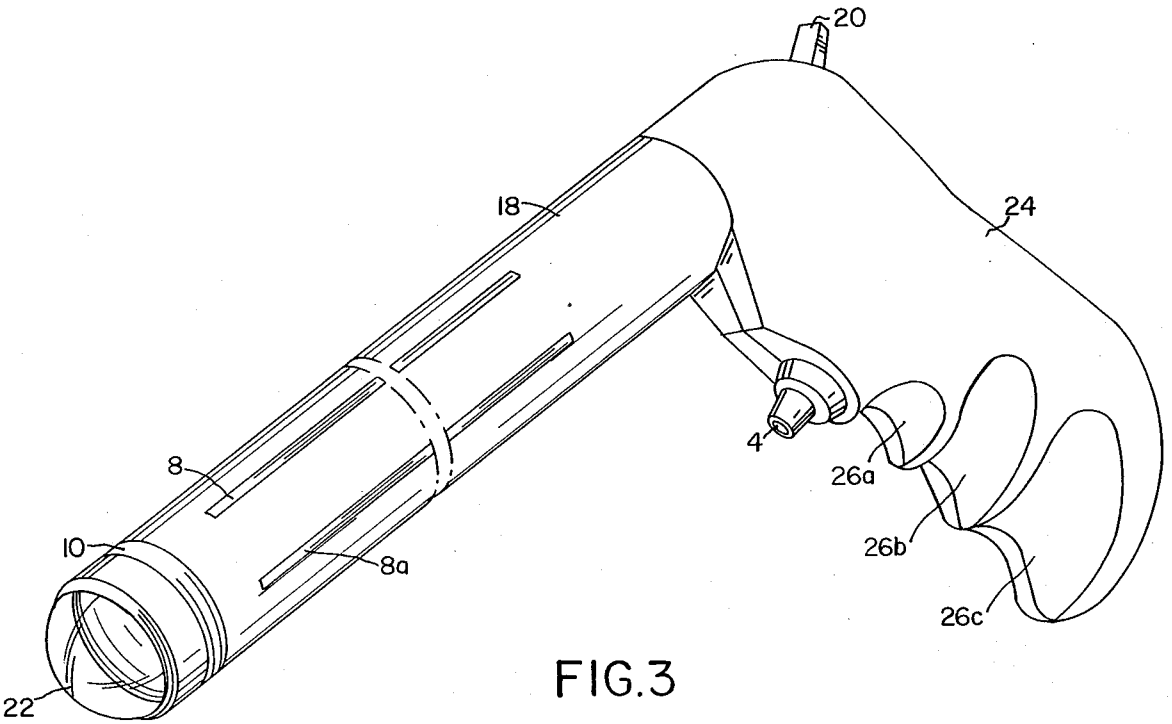
FIG. 3 is a pictorial representation of the present invention utilizing a pistol grip and a variable length main body portion.

Referring now to FIG. 3, the piston grip version of the present invention can be seen. Identical part numbers are designated for the main body portion 8 and the parts thereto previously described. In this view, toggle switch 20 is moved to a position upon the piston grip handle 24 for easy thumb utilization. Switch 4 has been moved to the trigger position, again for convenience of the user. Contoured finger receiving grooves 26*a*, 26*b* and 26*c* are provided for security and comfort.

Figure 6:
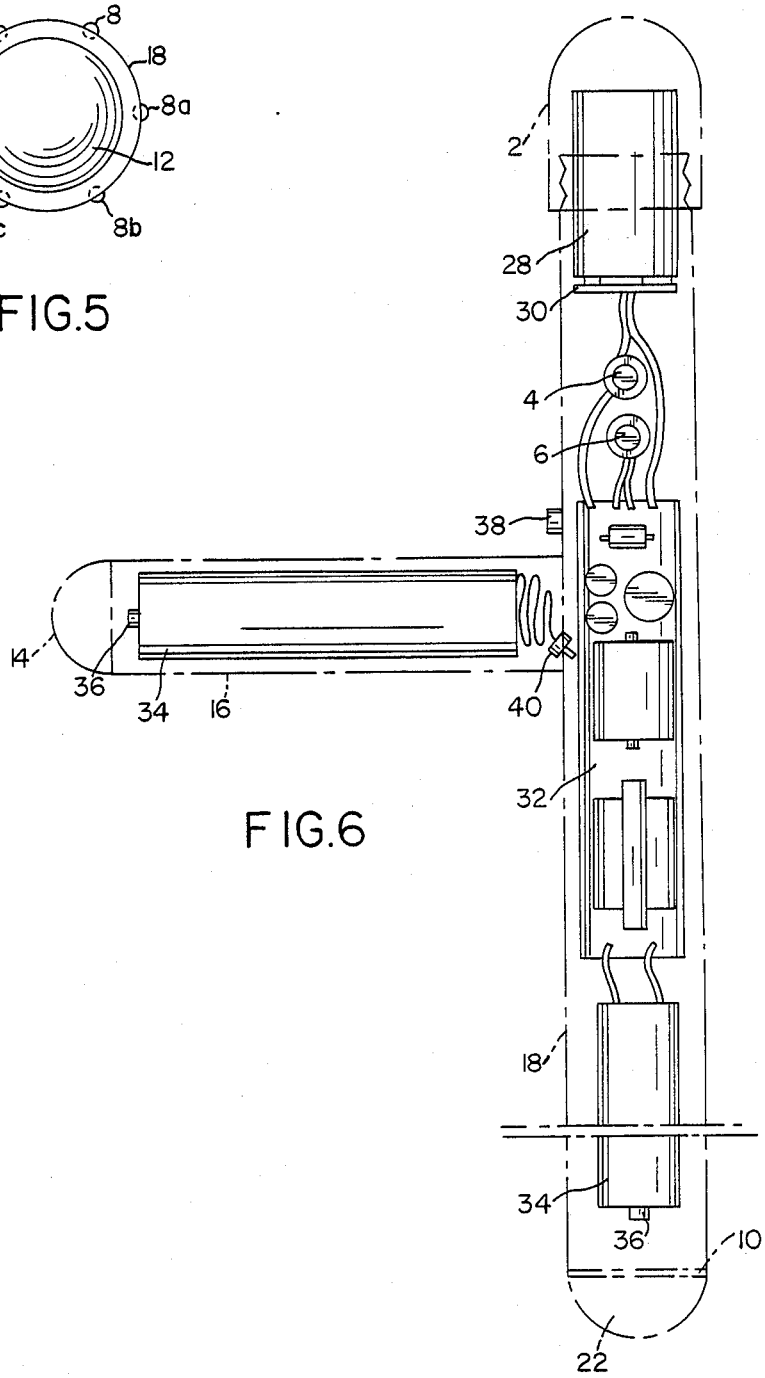
FIG. 6 is a phantom representation of the device as in FIG. 1 showing the arrangement of the internal elements.

As seen in FIG. 6, a pictorial of power supply is displayed as 32.

Figure 4:
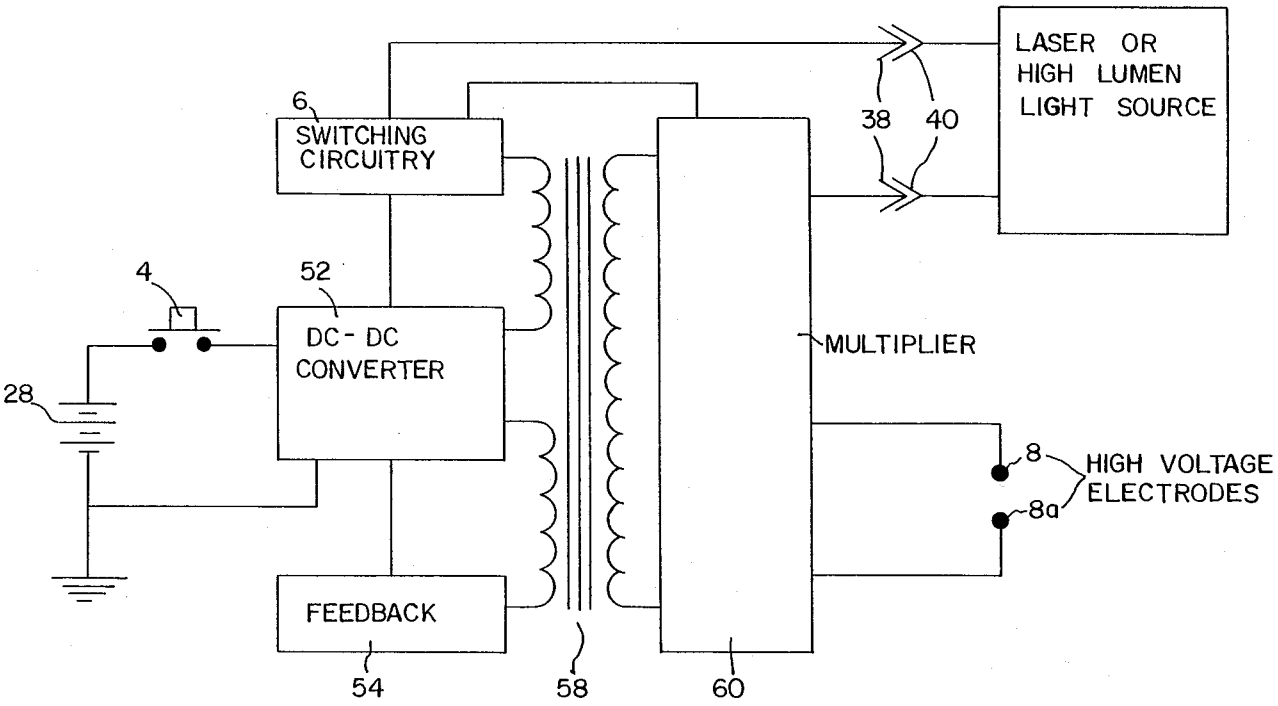
FIG. 4 is an electric circuit for the present invention.

Referring now to FIG. 4, a simplified circuit diagram is shown including the main on/off switch 4 for the battery 28, the DC converter 52, the switching circuitry, which for simplicity is designated as 6, the feedback circuit 54, magnetic solid core transformer 58, multiplier 60 and the jacks 38, 40 for utilization when plugging in the laser as a remote gun sight or the like. Further connected to the multipler 60 are the high voltage electrodes 8, 8*a*.

Figure 5:
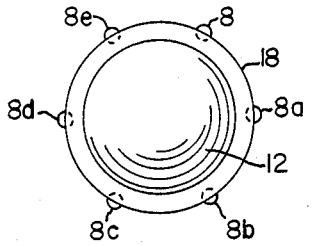
FIG. 5 is a front end view of the device pictured in FIG. 2.

As seen in FIG. 5, the main body portion 18 has embedded in its exterior surface a plurality of electrodes 8, 8*a*, 8*b*, 8*c*, 8*d*, 8*e* which are three pair of electrodes. It is to be noted that the gap between the electrodes 8–8*e* is slightly greater than the gap between the end of the electrodes 8–8*e* and the energy director or discharge ring 10 such that the operator may selectively discharge a forwardly projecting continuous intimidating display.

Also to be seen in this view is the end cap 12, which, if the instrument includes a light source, will be optically clear (22 as seen in FIGS. 3 and 6).

Referring now to FIG. 6, the various elements or components which make the present device operable can be seen in the preferred position. It is important to point out at this point that the configuration includes an internal battery 28 cooperating with a connection clip 30. Clip 30 is hardwired to switches 4 and via the switching circuit to switch 6. Mounted in the sidearm is a laser light source 34 including a laser light output mirror attenuator 36 and a coaxial 2500 volt jack 40 which mates with jack 38 on the main body portion. At the forward end of the main body portion 18 is another laser light source 34, 36 which has an optically clear removable end cap 14.

Thus as can be seen, the present invention contemplates a simple, rugged device which can be used for crown or individual control and includes a self-contained utility capable of powering auxiliary equipment.

I claim:

1. An improved hand carried stick, for law enforcement personnel, functioning as a billy, night stick, or baton, in conventional ways, with additional self contained components which, when selectively activated, via finger tipped switches, provide more control power when subduing a person, or persons in a crowd, comprising:

(a) a main hollow lightweight body made of a strong non conducting material having a handle end portion and a continuing projecting portion;

(b) a self contained assembly of essentially end to end arranged electrical components and overall circuitry placed within the hollow body and extending from the handle end portion and continuing on throughout the continuing projecting portion, comprising:

overall circuitry;

a low voltage battery electrical energy source;

a push-button switch to control the passage of battery electrical energy to the overall circuitry;

a three position switch to selectively control the operations of the overall circuitry, after the push-button switch is activated;

the said overall circuitry, in turn comprising a direct current to direct current converter circuit, a feedback circuit, a magnetic solid core transformer circuit, and a multiplier circuit;

a laser light source connected to the overall circuitry;

a discharge ring connected to the overall circuitry and positioned in the continuing projecting portion at the end thereof; and a grouping of paired longitudinal electrodes, paired to receive positive and negative charges, with these paired longitudinal electrodes spaced about the self contained assembly of essentially end to end arranged electrical components, and partially longitudinally embedded in the continuing projecting portion of the main hollow lightweight body and connected to the overall circuitry;

(c) a combined end cap and lens to cover over the end of the continuing projecting portion; and (d) an end cap to cover over the hand held end portion;

(e) a second handle hollow portion of like body construction secured perpendicularly to the main hollow lightweight body at the locale of where the handle end portion of main body ends and the continuing projecting portion of the main body commences, whereby this second handle hollow portion is optionally used, when directing the laser light; and (f) a second laser light source removably connected to the overall circuitry and positioned within this second handle hollow portion, which is then removably attached to the main hollow lightweight body, and which then also has a combined end cap and lens to cover the projecting end thereof, and uncoilable circuitry used in removably connecting this second laser light source, 2. An improved hand carried stick for law enforcement personnel, as claimed in claim 1, having an electrical jack outlet on the main hollow lightweight body, and a complementary electrical jack inlet included in the uncoilable circuitry, whereby upon the connection of the jack outlet and jack inlet, the electrical energy source and the overall circuitry are connected to the second laser light source.

* * * * *